US007980162B2

(12) United States Patent
Barnes et al.

(10) Patent No.: US 7,980,162 B2
(45) Date of Patent: Jul. 19, 2011

(54) ROTARY PUNCH

(75) Inventors: Benjamin A. Barnes, Chesterland, OH (US); Yiming Dai, Bolingbrook, IL (US); George Oratowski, Aurora, IL (US); Michael Schmidt, Schaumburg, IL (US)

(73) Assignee: Formtek Metal Forming, Inc., Westfield, MA (US)

( * ) Notice: Subject to any disclaimer, the term of this patent is extended or adjusted under 35 U.S.C. 154(b) by 424 days.

(21) Appl. No.: 11/936,457

(22) Filed: Nov. 7, 2007

(65) Prior Publication Data

US 2008/0105098 A1 May 8, 2008

Related U.S. Application Data

(60) Provisional application No. 60/864,888, filed on Nov. 8, 2006.

(51) Int. Cl.
*B26D 1/56* (2006.01)

(52) U.S. Cl. ..... 83/284; 83/37; 83/320; 83/321

(58) Field of Classification Search ..... 83/284, 83/312, 435.11, 684, 685, 697, 698.91, 37, 83/292–295, 299, 300, 310, 318–327, 404.1, 83/405, 433

See application file for complete search history.

(56) References Cited

U.S. PATENT DOCUMENTS

| | | | | |
|---|---|---|---|---|
| 3,722,336 | A * | 3/1973 | Sarring | 83/63 |
| 3,733,947 | A * | 5/1973 | Bryson et al. | 83/280 |
| 3,848,494 | A * | 11/1974 | Gargrave et al. | 83/109 |
| 4,615,249 | A * | 10/1986 | Geiser | 83/221 |
| 5,195,412 | A * | 3/1993 | Flemming et al. | 83/37 |
| 6,205,898 | B1 | 3/2001 | Surina | |
| 7,117,777 | B1 * | 10/2006 | Wilkes | 83/320 |
| 2002/0092394 | A1 * | 7/2002 | Rathert | 83/213 |
| 2003/0079584 | A1 * | 5/2003 | Cote et al. | 83/13 |

* cited by examiner

*Primary Examiner* — Phong H Nguyen
(74) *Attorney, Agent, or Firm* — McCormick, Paulding & Huber LLP

(57) ABSTRACT

A rotary punch includes an upper die plate, a lower die plate, and a support frame having a drive assembly that moves the upper die plate horizontally and vertically along a generally circular pathway. The lower die plate is connected to the support frame for movement in a linear horizontal direction only. The upper die plate is vertically slidably connected to the lower die plate by way of one or more vertical rods attached to the upper die plate that extend down through bushings provided in the lower die plate. In operation, the lower die plate horizontally follows the upper die plate as the latter is moved along its circular pathway. Concurrently, the upper plate moves towards and away from the lower plate. This maintains a substantially constant alignment between the die plates for carrying out a periodic machining operation on a moving web of material passing there between.

11 Claims, 8 Drawing Sheets

ROTARY PUNCH

CROSS REFERENCE TO RELATED APPLICATION

This application claims the benefit of U.S. Provisional Application Ser. No. 60/864,888, filed Nov. 8, 2006, incorporated by reference herein in its entirety.

FIELD OF THE INVENTION

The present invention relates to machine tools and, more particularly, to devices for performing machining operations on a moving web of metal or similar material.

BACKGROUND OF THE INVENTION

For maximizing manufacturing throughput on an industrial scale, metal sheets are oftentimes processed as a moving web of material. Thus, an elongate sheet of metal is driven past a series of manufacturing stations, typically on a conveyor or similar moving support, where various machining or other operations are carried out on the moving web. One such operation involves applying a die set to the metal web, for deforming the web in a desired manner. For example, the die set may include a punch and a die, which, when pressed together with the web in between, form a hole in the web.

For carrying out punching operations on a moving web of metal, one or more punches are typically attached to the surface of a rotating drum or wheel, which is deployed on one side of the metal web. The other side of the metal web is supported in a complementary manner, e.g., a die or other support surface. The drum is carefully speed matched to the speed of the web. As the drum rotates, the punches on the surface of the drum are rotated into punching contact with the moving web, forming a hole or other desired feature. However, because the drum moves in a rotating manner whereas the web is moving linearly, there is a non-ideal interaction between the punch and web. In particular, not only does the punch move in a vertical direction with respect to the web, as in an ideal punching operation, but there is a concomitant degree of relative lateral motion as well. This "sweeping" or "wiping" motion of the punch causes the edges of the punch to laterally interact with the web, which can damage the punch or at least severely limit the times between required changeover or retooling.

SUMMARY OF THE INVENTION

It is an object of the present invention to provide a rotary punch that mimics, in an ongoing and continuous basis, an ideal punching operation (or other die-based machining operation) on a moving web of metal or other material.

To achieve this and other objects, an embodiment of the present invention relates to a rotary punch having a support frame, an upper die plate assembly, and a lower die plate. (In this context, "rotary punch" refers to a machine tool using a die set for carrying out a periodic or repeating machining operation on a web of material, including, but not limited to, punching operations.) The support frame includes a drive assembly, which rotates or drives the upper die plate assembly both horizontally and vertically along a generally circular pathway. The lower die plate is connected to the support frame for movement in a linear horizontal direction only, that is, the lower die plate is limited to moving horizontally back-and-forth. The upper die plate assembly is slidably connected to the lower die plate, e.g., by way of one or more vertical alignment rods that extend through bushings provided in the lower die plate. Thus, in operation, as the upper die plate assembly is moved horizontally and vertically along its circular pathway, the lower die plate horizontally follows or tracks along with the upper die plate assembly, as the upper die plate concurrently moves towards and away from the lower die pate. This maintains a substantially constant alignment between the lower die plate and the upper die plate assembly for carrying out a periodic machining operation on a moving web of material passing between the upper die plate assembly and the lower die plate. (By "substantially" constant, it is meant constant but for variances originating from manufacturing tolerances.)

In another embodiment, when the upper die plate assembly is driven to move horizontally at a speed that matches the speed of the moving web of material (with the lower die plate following along), that is, the horizontal component of the upper die plate assembly's movement matches the speed of the moving web, there is substantially no relative horizontal movement between the upper die plate assembly, the lower die plate, and the moving web of material, during at least part of the time when the upper die plate assembly is moved vertically towards the lower die plate for carrying out the machining operation on the moving web of material. In this manner, the upper die plate assembly and lower die plate are speed matched to the moving web, while concurrently moving toward one another (relatively speaking), for performing the punching operation or other machining operation. This mimics, or at least substantially approximates, an ideal machining operation on a web of material, where there is no unwanted relative lateral movement between the die plates and web of material.

In another embodiment, the upper die plate assembly includes two parallel, vertically oriented side plates (each carrying a cylindrical bearing), one or more vertical alignment rods attached to the top of each of the side plates, and an upper die plate attached to the top ends of the alignment rods. The upper die plate assembly is slidably connected to the lower die plate. In particular, the alignment rods extend vertically through bushings provided in the lower die plate, for the upper die plate assembly to slide vertically towards and away from the lower die plate. The lower die plate is carried on opposed linear bearing and rail assemblies attached to the support frame, and is positioned between the upper die plate and the side plates of the upper die plate assembly. The drive assembly is a crankshaft having two aligned, offset journals. The journals are connected to the cylindrical bearings of the upper die plate assembly side plates. Thus, when the crankshaft is rotated about its axis, the offset journals move about a circular orbit, which in turn causes the upper die plate assembly side plates, and thus the entirety of the upper die plate assembly, to move along the generally circular pathway. (As should be appreciated, because the upper die plate assembly is slidably connected to the lower die plate, which cannot move vertically, the upper die plate assembly is maintained at a substantially constant attitude as it moves along its circular pathway.)

In another embodiment, for carrying out a machining operation, the rotary punch includes a die connected to the top surface of the lower die plate, and a work member, complementary to the die, connected to the bottom surface of the upper die plate. For example, the work member may be a punch for generating a hole in the moving web of material. In such a case, the lower die plate may include a drop aperture cooperative with the die and punch for removing waste material.

In another embodiment, the rotary punch includes two gusset plates, which are attached to the underside of the lower die plate and extend downwards there from. A bottom support or stiffening plate is attached to the lower ends of the gusset plates. The alignment rods of the upper die plate assembly are slidably connected to the bottom stiffening plate, similarly as with the lower die plate. The gusset plates and bottom stiffening plate form a box section in conjunction with the lower die plate, which stiffens the lower die plate and helps to stabilize the moving portions of the rotary punch.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
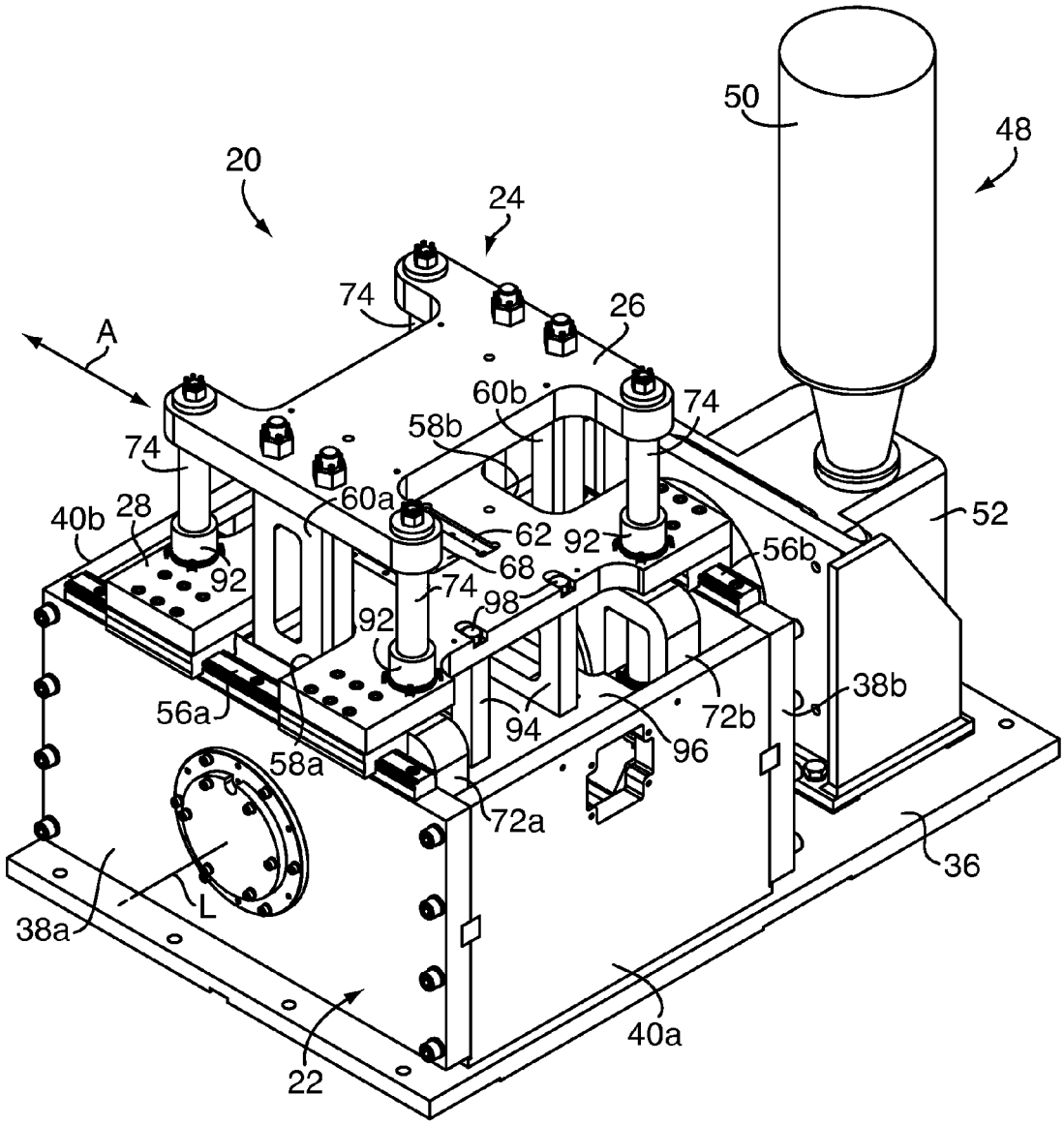
FIG. 1 is a first perspective view of a rotary punch according to an embodiment of the present invention.

With reference to FIGS. 1-9H, a rotary punch 20 includes a support frame 22, an upper die plate assembly 24 having an upper die plate 26 (also referred to herein as the primary die plate assembly and die plate), and a lower die plate 28 (also referred to herein as a secondary die plate). The support frame 22 includes a drive assembly 30, which rotates or drives the upper die plate assembly 24 both horizontally and vertically along a generally circular pathway 32. The lower die plate 28 is connected to the support frame 22 for movement in a linear horizontal direction only, that is, the lower die plate is limited to back-and-forth horizontal movement, as indicated in the drawings by arrow "A." The upper die plate assembly 24 is vertically slidably connected to the lower die plate 28. Thus, in operation, as the upper die plate assembly 24 is moved horizontally and vertically along its circular pathway 32, the lower die plate 28 horizontally follows (i.e., tracks along with) the upper die plate assembly 24, as the upper die plate 26 concurrently moves towards and away from the lower die pate 28. This maintains a substantially constant alignment between the lower die plate 28 and the upper die plate 26 for carrying out a periodic or repeating machining operation on a moving web of material 34 passing between the upper die plate 26 and the lower die plate 28.

When the upper die plate assembly 24 is driven so that the speed its horizontal component of movement matches the speed of the moving web of material 34 (with the lower die plate 28 following along), there is substantially no relative horizontal movement between the upper die plate 26, the lower die plate 28, and the moving web of material 34, at least during part of the time when the upper die plate assembly is moved vertically towards the lower die plate for carrying out the machining operation on the moving web of material 34. In this manner, the upper die plate assembly 24 and lower die plate 28 are speed matched to the moving web 34, while concurrently moving toward one another in a relative sense, for performing a punching operation or other machining operation. This mimics (or at least substantially approximates) an ideal machining operation on a web of material, where there is no unwanted relative lateral movement between the die plates and web of material.

As indicated above, although the present invention is characterized as being a "rotary punch," this is meant to refer more generally to a machine tool that uses a die set for carrying out a periodic or repeating machining operation on a web of material. One possible machining operation, of course, is a true punching operation, for removing material from the web to form apertures therein. "Rotary" refers to the rotation of the drive assembly axle or crankshaft, and also to the machine tool working in a cyclical manner, for repeating the machining operation on a moving web of material.

With reference to FIGS. 1-6, the various parts of the rotary punch 20 will now be explained in more detail. The support frame 22, as its name indicates, is a stationary assembly used for supporting and protecting the moving parts of the rotary punch. The support frame 22, which will typically be stationed on a floor or other base 36, includes left and right support frame plates 38*a*, 38*b*. The plates 38*a*, 38*b* are generally parallel and generally vertically oriented, and are spaced apart by a distance meant to accommodate the lower die plate 28 and upper die plate assembly 24. The left and right support frame plates 38*a*, 38*b* function to support both the lower die plate 28 and the drive assembly 30. The support frame 22 also includes front and rear support frame plates 40*a*, 40*b*, attached to the left and right plates 38*a*, 38*b*, which serve to cover internal/ moving components, and which act as additional stiffening or support members for the support frame. For example, as shown in FIG. 1, the plates 38*a*, 38*b*, 40*a*, 40*b* together form a box-like structure, which provides a greater level of support than if side plates 38*a*, 38*b* were used alone. (Note that the front and rear plates 40*a*, 40*b* are shown removed in FIG. 2.)

The plates 38*a*, 38*b*, 40*a*, 40*b*, like most of the plate components of the rotary punch 20 described herein, are generally planar, and are made out a very heavy gauge (e.g., 0.5"-2" thick) sheet steel or other strong and sturdy metal. This facilitates use of the rotary punch 20 for performing machining operations on metal webs. If the punch 20 is meant to be used for machining operations on light gauge materials such as very thin, malleable, or soft metals, or on certain plastics, then it may be possible for the punch plates and other components to be lighter duty in nature.

The drive assembly 30 is carried on the support frame 22, and includes an axle or crankshaft 42 and two aligned, offset circular journals 44*a*, 44*b*. The crankshaft 42, lying parallel to the base 36, extends between and is supported by the left and right support frame plates 38*a*, 38*b*. The crankshaft 42 is attached to the left and right support frame plates 38*a*, 38*b* by way of two support bearings 46*a*, 46*b* that are disposed in the left and right support frame plates 38*a*, 38*b*, respectively. As such, the crankshaft 42 is free to rotate about its fixed longitudinal axis "L" (see FIG. 6). The journals 44*a*, 44*b* are generally cylindrical members having a relatively short height (relative to the crankshaft), but diameters that are substantially larger than the diameter of the crankshaft 42. The journals 44*a*, 44*b* are aligned with one another, and are non-movably connected to the crankshaft 42 to lie proximate to the left and right support frame plates 38*a*, 38*b*, respectively. Additionally, the journals 44*a*, 44*b* are offset with respect to the crankshaft 42, meaning that the journals 44*a*, 44*b* are not coaxial with the crankshaft 42. As indicated in particular in FIG. 6, it may be the case that the journals are substantially offset, such that the common axis of the journals is displaced as far as possible from the crankshaft axis L while still maintaining a robust connection with the crankshaft 42, e.g., the bodies of the crankshaft and journals are coextensive. Operation of the crankshaft and journals is discussed below.

A standard motor unit 48 may be used to drive the crankshaft 42. The motor unit 48 includes a servo motor 50, a gearbox or reducer 52 (if required for the type of motor used), and a motor unit output spindle or similar connection means 54 for connecting the rotating output of the motor unit 48 to the crankshaft 42. Other types of crankshaft drive units are possible for rotating the crankshaft, such as internal combustion engines, pulley systems, and the like.

The lower die plate 28 is disposed between the left and right support frame plates 38*a*, 38*b*, and is connected thereto for moving in a linear horizontal direction "A." (Typically, the linear horizontal direction "A" corresponds to the direction of travel of the moving web of material 34.) For this purpose, first and second linear bearing and rail assemblies 56*a*, 56*b* are respectively attached to the top edges of the left and rights support frame plates 38*a*, 38*b*. The linear bearing and rail assemblies 56*a*, 56*b* allow the lower die plate 28 to move back-and-forth in the direction "A," but otherwise prevent the lower die plate from moving. In particular, the lower die plate is vertically fixed, meaning that it is prevented from moving vertically up or down, or from twisting or angling out of the horizontal. (In the context of the lower die plate, the designation "horizontal" or "lateral" refers to a plane defined by the lower die plate, or a plane parallel to that plane, not necessarily to a plane that lies horizontal to the ground. "Vertical" refers to a direction perpendicular to the plane defined by the lower die plate.)

In the embodiment shown in the drawings, the lower die plate 28 is generally H-shaped, with the legs of the "H" shape being defined by two side clearance cutouts 58*a*, 58*b*. The cutouts 58*a*, 58*b* accommodate the passage of two vertical reinforcement braces 60*a*, 60*b*, which are part of the upper die plate assembly 24, as discussed in more detail below. The lower die plate 28 also includes fixtures 62 for attaching the die portion 64 of a die set (which includes the die 64 and a punch or other work member 66) to the top surface of the lower die plate 28. If the machining operation carried out by the rotary punch 20 involves the removal of material from the web of material 34, then the lower die plate 28 will also typically include a drop aperture 68 for facilitating the passage of waste material 70 (see FIG. 9E) from the rotary punch.

Figure 5:
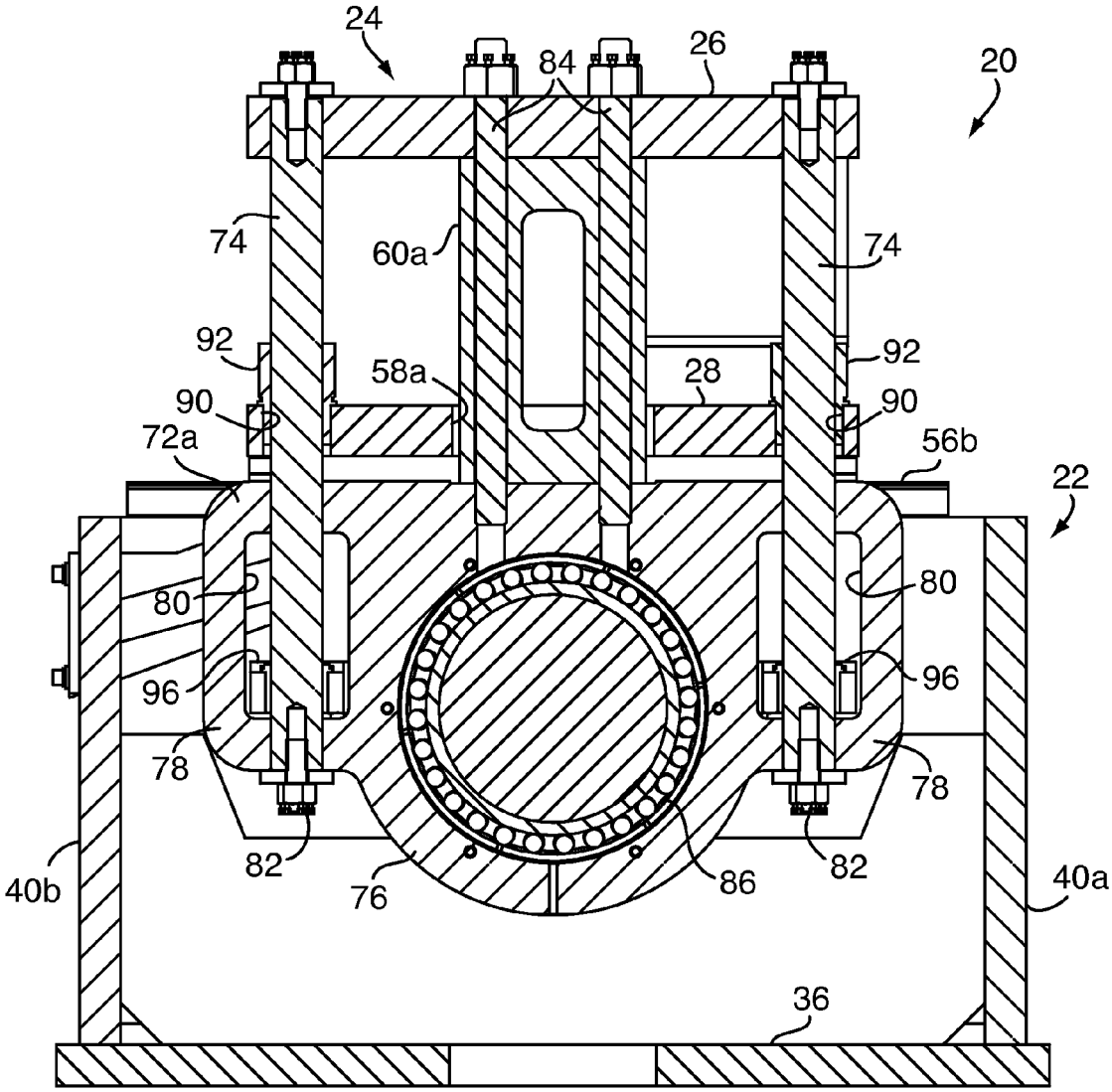
FIG. 5 is a first longitudinal cross-section view of the rotary punch, showing in particular an upper die plate assembly portion of the rotary punch, taken along line 5-5 in FIG. 3.

The upper die plate assembly 24 includes two parallel, vertically oriented side plates 72*a*, 72*b*, two vertical alignment rods 74 attached to the top edge of each of the side plates 72*a*, 72*b* (there are four rods 74 in total), the vertical reinforcement braces 60*a*, 60*b*, and the upper die plate 26, which is attached to the top ends of the alignment rods 74 and vertical reinforcement braces 60*a*, 60*b*. The upper die plate 26 is generally I-shaped, and lies generally parallel to the lower die plate 28. Like the lower die plate, the upper die plate includes standard fixtures (not shown) for attaching a punch or other die set work member 66 to the underside of the upper die plate. The side plates 72*a*, 72*b* are positioned proximate (and generally parallel) to the left and right support frame plates 38*a*, 38*b*, respectively. As best shown in FIG. 5, each side plate 72*a*, 72*b* includes a center body portion 76 and two "wings" 78 attached to each side of the body portion 76. A generally rectangular-shaped, vertically oriented aperture 80 extends laterally through each wing 78. In the case of each wing 78, one of the alignment rods 74 extends from the bottom of the wing, vertically through the aperture 80, through the top of the wing, and up to the upper die plate. The wings 78 are provided with vertical apertures or through-bores for accommodating the rods 74 in this manner. The rods 74 are attached to the side plates 72*a*, 72*b* using bolts 82 or another standard fastener. The vertical reinforcement braces 60*a*, 60*b* are attached to the top edges of the side plates 72*a*, 72*b* above the body portions 76 of the side plates, and extend upwards for attachment to the upper die plate 26. The vertical reinforcement braces 60*a*, 60*b* are attached to the side plates 72*a*, 72*b* and upper die plate 26 using elongated connection bolts 84 or the like.

In total, the upper die plate assembly 24 includes the side plates 72*a*, 72*b*, the upper die plate 26, and the alignment rods 74 and vertical reinforcement braces 60*a*, 60*b*, which connect the side plates and upper die plate together. These components are non-movably attached to one another, thereby forming a stiffened, generally Π-or U-shaped unitary body that moves together as a unit.

Each upper die plate assembly side plate 72*a*, 72*b* is outfitted with a cylindrical bearing 86, which is located in a corresponding bearing aperture 88 formed in the side plate. In turn, the offset journals 44*a*, 44*b* of the drive assembly 30 are respectively positioned in the bearings 86, in a laterally fixed manner so that the journals do not become misaligned or disengaged from the bearings. The cylindrical bearings 86 allow the side plates 72*a*, 72*b* to rotate with respect to the journals, in a low-friction manner. Additionally, the drive assembly 30 (which includes the crankshaft and journals) supports the upper die plate assembly 24 in the support frame 22. The upper die plate assembly rests on the journals and crankshaft, with the crankshaft in turn being supported by the left and right support frame plates 38*a*, 38*b*.

The vertical alignment rods 74 of the upper die plate assembly 24 extend through the lower die plate 28, and are vertically slidable with respect thereto. For this purpose, the lower die plate 28 is provided with vertically oriented rod apertures 90 and bushings 92 that accommodate the alignment rods 74 in a sliding, low-friction manner. This enables the upper die plate assembly 24 to move vertically towards and away from the lower die plate 28, while remaining aligned therewith at a substantially constant attitude. The vertical reinforcement braces 60*a*, 60*b* also extend through the plane of the lower die plate and move vertically with respect thereto, but merely pass through the side cutouts 58*a*, 58*b* in the lower die plate, without contacting the lower die plate, as opposed to engaging the lower die plate in a sliding manner through use of bushings or otherwise.

Figure 2:
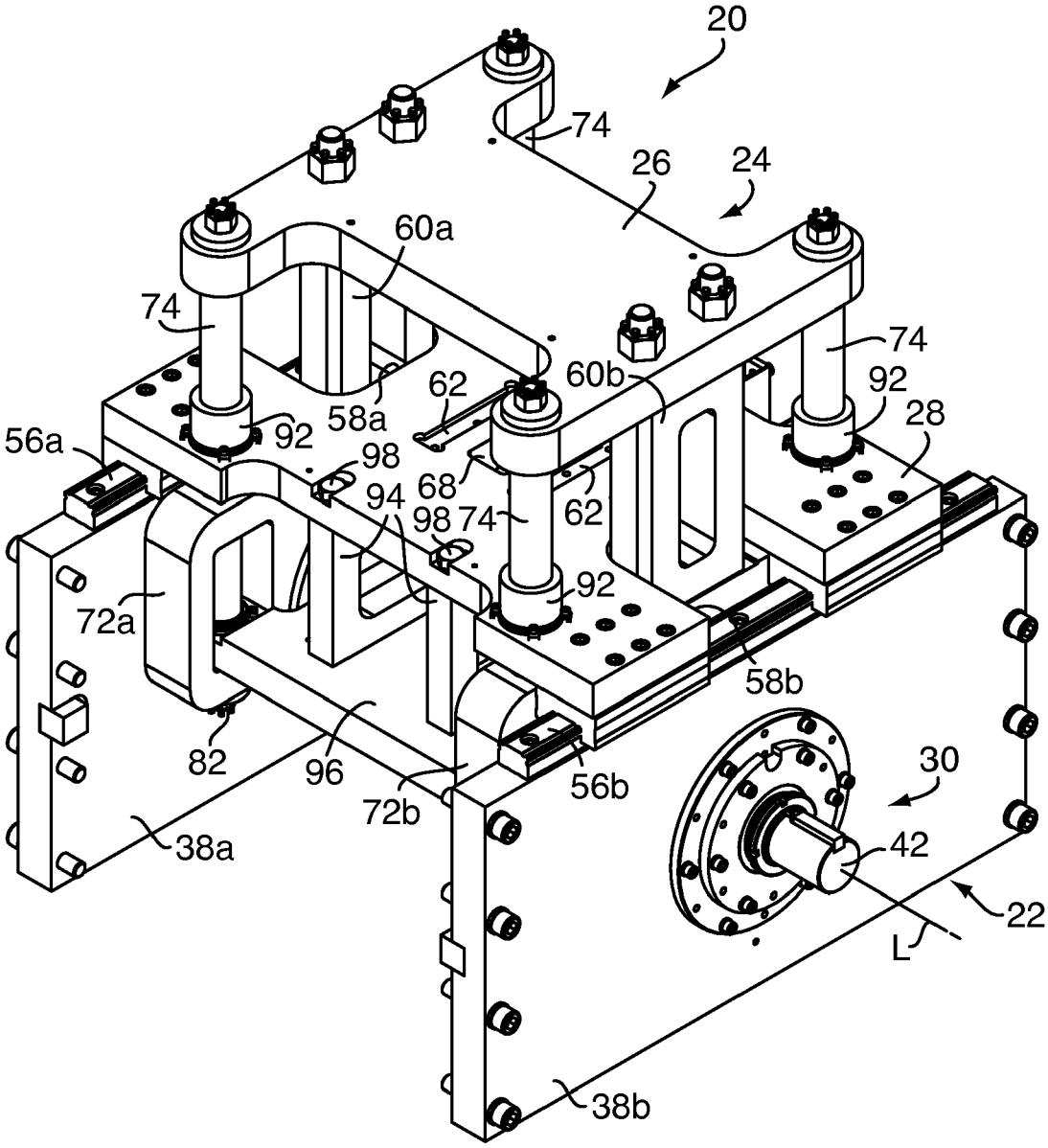
FIG. 2 is a second perspective view of the rotary punch.
Figure 3:
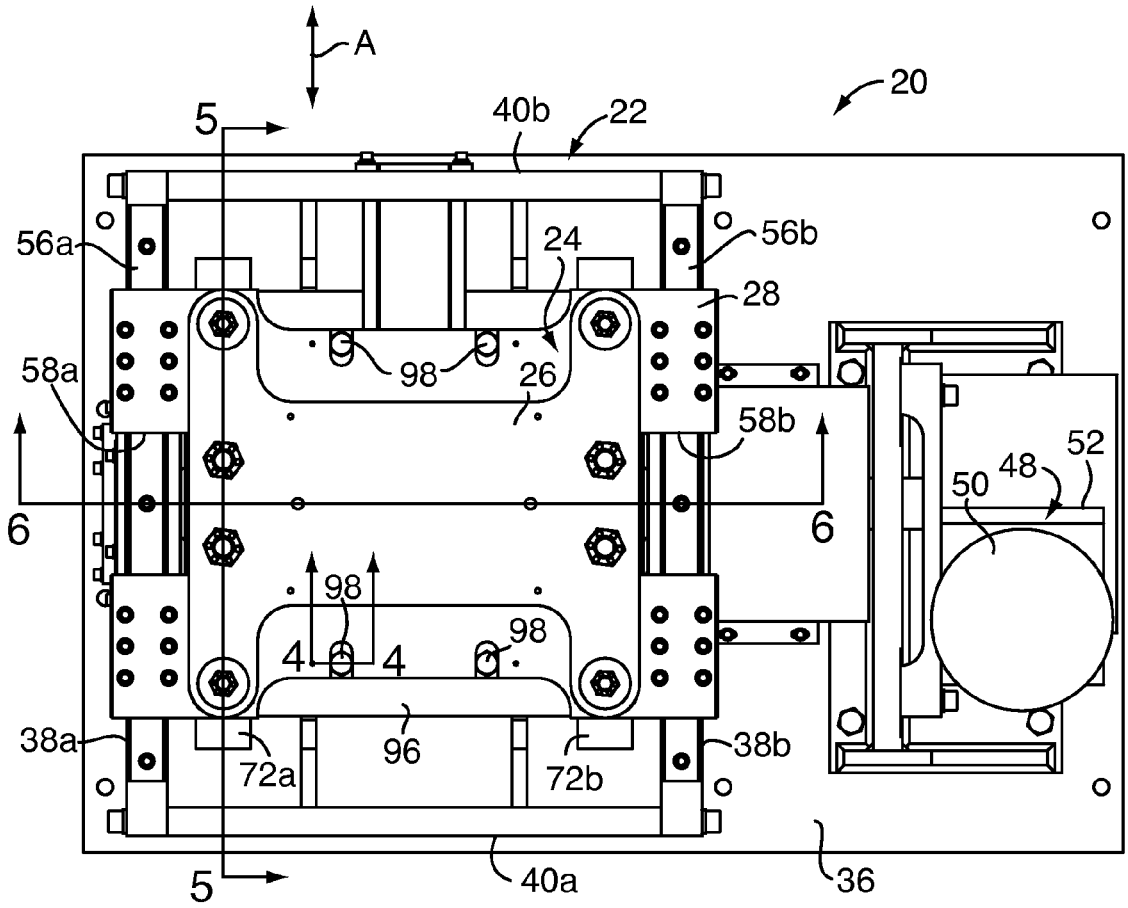
FIG. 3 is a top plan view of the rotary punch.
Figure 6:
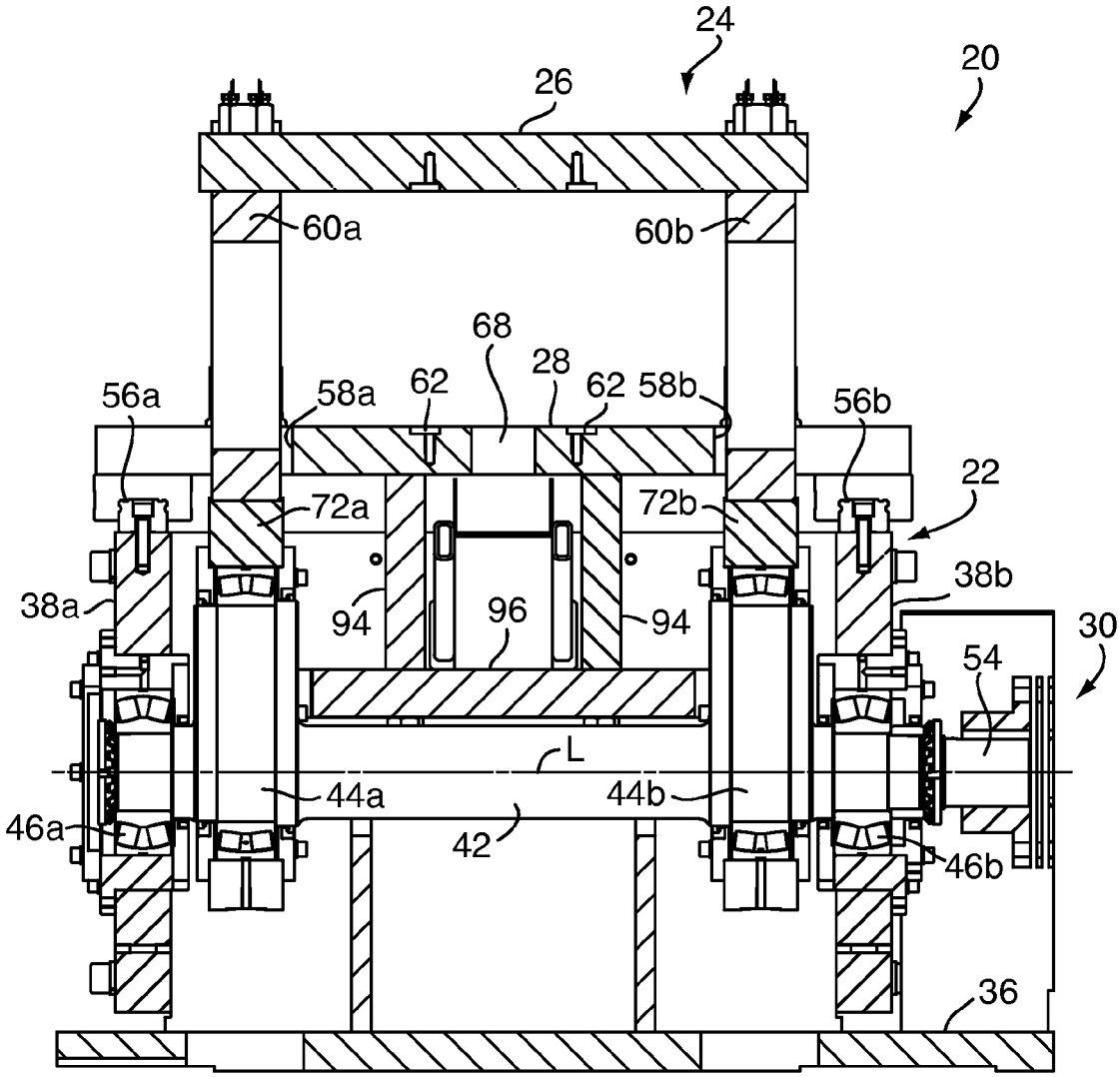
FIG. 6 is a second longitudinal cross-section view of the rotary punch, showing in particular a drive assembly of the rotary punch, taken along line 6-6 in FIG. 3.

Optionally, the rotary punch 20 also includes a means for stiffening and reinforcing the lower die plate 28. As best shown in FIGS. 2 and 6, the stiffening means may include two gusset plates 94 and a bottom support or stiffening plate 96. The gusset plates 94 are vertically oriented, and extend downwards from the underside of the lower die plate 28, to which the gusset plates are attached. The stiffening plate 96, which lies generally parallel to the lower die plate, is attached to the lower or bottom ends of the gusset plates. The alignment rods 74 of the upper die plate assembly are slidably connected to the bottom stiffening plate 96, similarly as with the lower die plate. For example, the stiffening plate 96 may be provided with apertures and bushings for this purpose. (As should be appreciated, the wing apertures 80 in the upper die plate assembly side plates expose a lower portion of each rod 74, which enables the rods to be vertically slidably attached to the stiffening plate 96.) The gusset plates 94 and bottom stiffening plate 96 form a box section in conjunction with the lower die plate 28, which stiffens the lower die plate and helps to stabilize the moving portions of the rotary punch.

Figure 4:
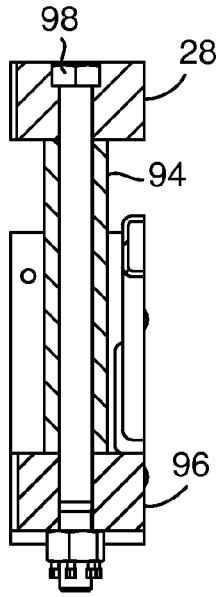
FIG. 4 is a cross-section view of a gusset and bottom plate connector portion the rotary punch, taken along line 4-4 in FIG. 3.

The gusset plates 94 and bottom stiffening plate 96 are attached to the lower die plate 28 in a standard manner, using machine bolts 98 or the like, as shown in FIG. 4.

Operation of the rotary punch is shown schematically in FIGS. 7A-9H. Generally speaking, the rotary punch 20 utilizes the rotary motion of the crankshaft 42 to produce both a linear horizontal motion of the upper and lower die plates and a vertical motion of the upper die plate towards and away from the lower die plate. For this, the motor unit 48 is controlled to rotate the crankshaft 42 about its fixed longitudinal axis L. As the crankshaft 42 rotates, the offset journals 44*a*, 44*b* move about a circular orbit, which in turn creates a circular movement of the upper die plate assembly side plates 72*a*, 72*b* (and the rest of the upper die plate assembly) in relation to the axis L of the crankshaft 42, along the circular pathway 32. As the upper die plate assembly moves along the circular pathway 32, it moves both horizontally and vertically. For example, from a starting point in FIG. 7A, with the crankshaft rotating counterclockwise in this instance, the upper die plate assembly moves both horizontally to the left and vertically downwards to an intermediate position shown in FIG. 7B. With continued rotation of the crankshaft, the upper die plate assembly continues moving vertically downwards but now horizontally to the right, to arrive at the position shown in FIG. 7C. Further rotation causes the upper die plate assembly to move horizontally right and upwards, to FIG. 7D, and then upwards and horizontally left to arrive back at the starting position in FIG. 7A. One rotation of the crankshaft produces one cycle of the upper and lower die plates.

Figure 7C:
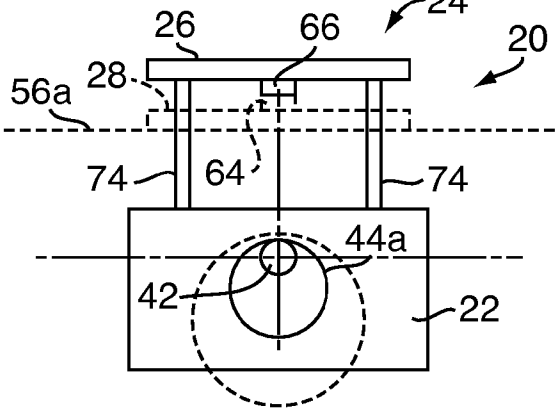
FIGS. 7A-7D are schematic views illustrating the drive assembly in operation.
Figure 7D:
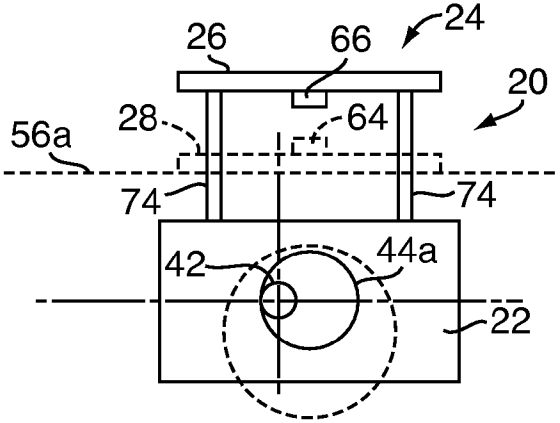
Figure 7A:
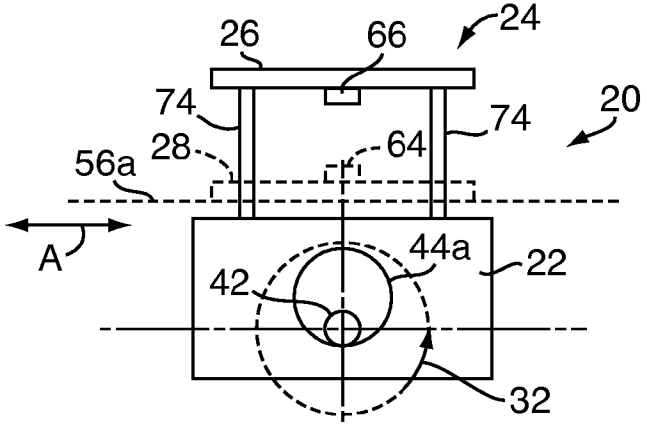

Because the upper die plate assembly is slidably connected to the lower die plate 28 (by way of the rods 74), as the upper die plate assembly 24 is moved vertically and horizontally along the circular path 32, the lower die plate 28 moves along with the the upper die plate assembly horizontally back and forth. (As explained above, the lower die plate is limited to this direction of movement by the linear bearing and rail assemblies 56*a*, 56*b*.) At the same time, the sliding connection between the upper die plate assembly and lower die plate serves to synchronize the two plates. More specifically, a substantially constant alignment is maintained between the upper and lower die plates as the upper die plate moves vertically, e.g., the upper die plate is maintained at a substantially constant attitude with respect to the lower die plate. When the upper die plate 26 is fully raised, as shown in FIGS. 2 and 7A, both plates 26, 28 are at the center of horizontal travel. In this position, the spacing between the plates 26, 28 is at a maximum. As the crankshaft rotates, the upper die plate 26 lowers as both plates 26, 28 move horizontally against the direction of travel of the moving web of material (e.g., from the position shown in FIG. 7A to the position in FIG. 7B). The upper die plate is at half stroke when both plates 26, 28 have moved the maximum distance horizontally (FIG. 7B), and the upper die plate 26 lies fully lowered, at its closest position to the lower die plate 28, when both plates return to the center of horizontal travel (FIG. 7C).

Figure 7B:
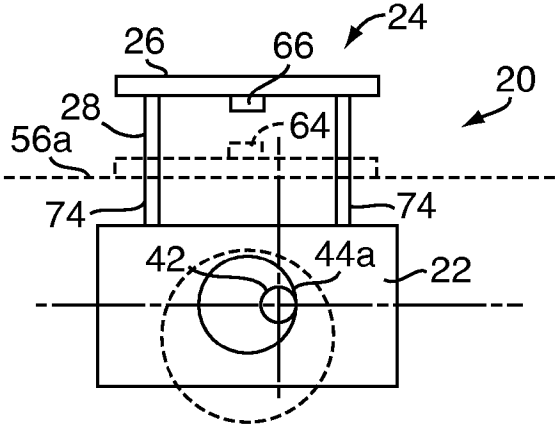
Figure 8:
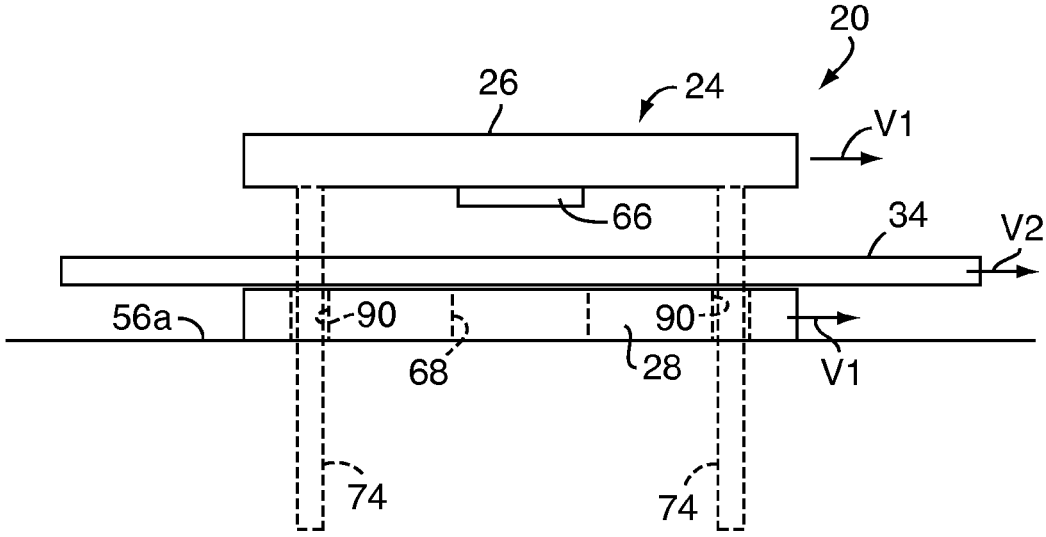
FIG. 8 is a schematic view illustrating a lateral moving alignment between upper and lower die plates and a moving web of material.

In the case of a die set, machining operations are carried out by forcing the work member portion 66 of the die set against (or towards) the die portion 64 of the die set, with a metal sheet or other material web lying between the two. Thus, in the rotary punch 20, the machining operation is carried out when the upper die plate 26 (which carries the punch or other work member 66) transitions from its initial half stroke (FIG. 7B) to its fully lowered position (FIG. 7C), with the lower die plate following along horizontally. The remaining segments of movement constitute the upper die plate disengaging from the lower die plate (FIG. 7C to FIG. 7D) and transitioning back for the next subsequent machining operation (FIG. 7D to FIG. 7A to FIG. 7B).

The primary purpose of the rotary punch is to perform punching or other machining operations on a moving web of metal 34 or other material. For doing so, the upper and lower die plates 26, 28, which are synchronized in terms of horizontal position and attitude, are speed matched to the speed of the moving web of material. Thus, with reference to FIGS. 7A-7D and 8, as the upper and lower die plates enter the stage of motion where both plates are moving in the same horizontal direction as the moving web of material and the upper die plate moves vertically downwards towards the lower die plate (see the transition from FIG. 7B to FIG. 7C), the horizontal speed "V1" of the two plates 26, 28 is set to match the horizontal speed "V2" of the moving web of material 34: V1=V2. With the two speeds being matched, there is substantially no relative horizontal movement between the upper die plate 26, the lower die plate 28, and the moving web of material 34 as the upper die plate 26 is moved vertically downwards towards the lower die plate 28, for carrying out the machining operation in question on the web of material. As noted above, this mimics an ideal punching or other die set-based operation, where the die and web are stationary, and the punch or other work member is moved vertically downwards against the web and die. This method has been found effective for punching holes in sheet steel traveling at speeds up to 350 fpm.

The upper and lower die plates are speed matched to the moving web of material using a standard control mechanism. The horizontal speed of the plates is a direct function of the rotational speed of the crankshaft, which is driven by the motor unit. The control mechanism monitors the speed of the web, and controls the motor to produce a corresponding speed in the upper and lower die plates, based on a simple mathematical calculation, reference to a lookup table, or the like.

Figure 9A:
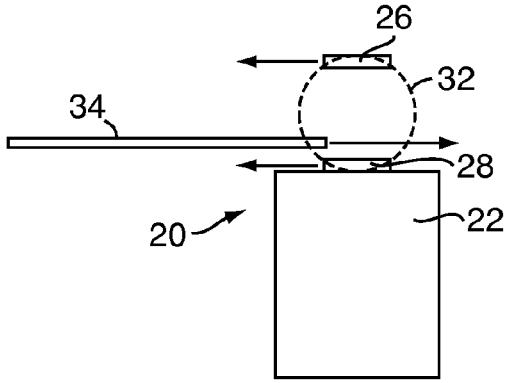
FIGS. 9A-9H are schematic views showing the rotary punch in operation.
Figure 9B:
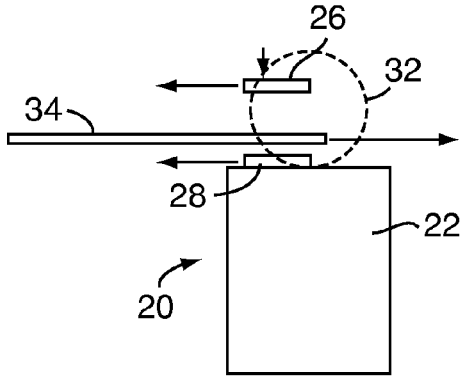
Figure 9C:
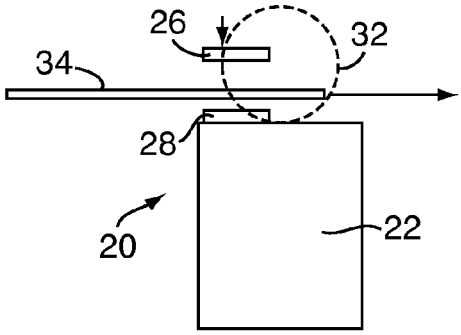
Figure 9D:
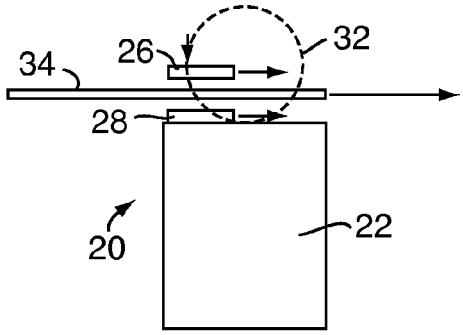
Figure 9E:
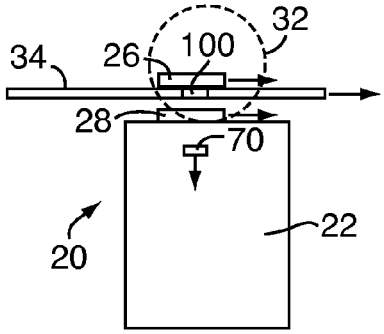
Figure 9F:
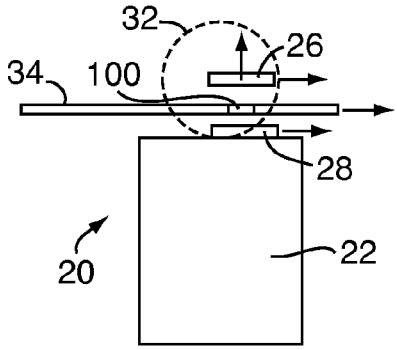
Figure 9G:
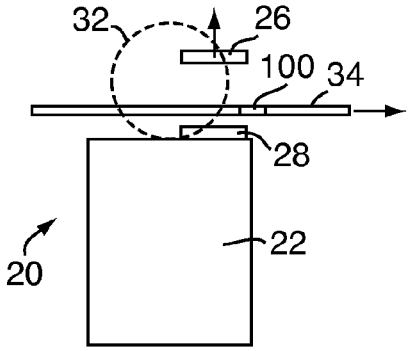
Figure 9H:
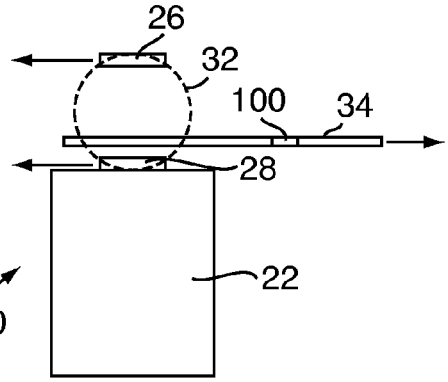

FIGS. 9A-9H summarize one cycle of operation of the rotary punch 20. Rotation of the crankshaft is counterclockwise in this view; arrows refer to directions of travel. In FIG. 9A, which corresponds to FIG. 7A, the upper die plate 26 is fully raised, and both plates 26, 28 are at the center of horizontal travel, moving against the direction of travel of the web 34. In FIG. 9B, both plates continue moving against the direction of travel of the web 34, and the upper die plate 26 starts moving downwards towards the lower die plate 28. In FIG. 9C, the plates reach their limit of horizontal movement against the direction of travel of the web. The upper die plate continues moving downwards. In FIG. 9D, the plates start moving horizontally in the direction of travel of the web. In FIG. 9E, the plates continue moving horizontally in the direction of travel of the web, and the upper die plate 26 reaches its lowest position, in its closest proximity to the lower die plate 28. In the transition to this position, the machining operation is carried out on the web 34, as between the die 64 and work member 66. For example, if the work member 66 is a punch, a hole 100 is punched in the web, with the slugs or other waste material 70 punched from the web dropping down through the drop aperture 68 in the lower die plate, and into a chute (not shown) that passes between the lower die plate, the stiffening plate, and the gusset plates, for exiting the rotary punch through a hole in the end of the support frame. In FIG. 9F, the plates continue moving horizontally along with the web, and the upper die plate 26 moves upwards away from the lower die plate. In FIG. 9G, the plates reach their limit of horizontal movement in the direction of travel of the web. The upper die plate continues moving upwards. In FIG. 9H, the plates return to their original position, as in FIG. 9A.

Figure 10:
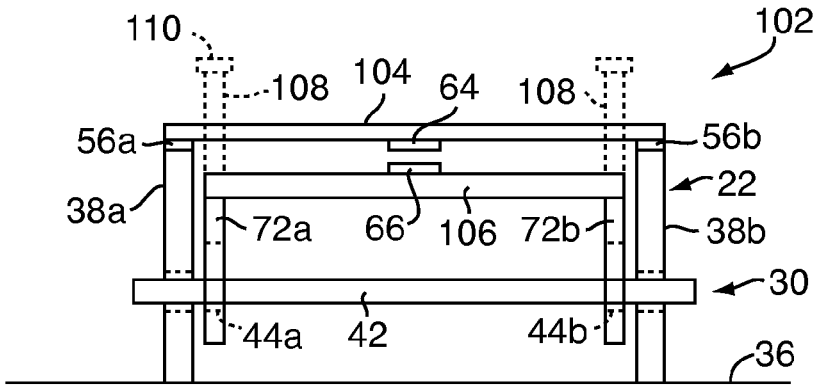
FIG. 10 is a schematic view showing an alternative embodiment of the rotary punch.

Although the die plates have been characterized as an "upper" and "lower" die plate, these are arbitrary designations. For example, as shown in FIG. 10, in an additional embodiment of the rotary punch 102, the horizontally limited die plate 104 could be positioned above the die plate 106 that moves vertically with respect thereto. The two plates would still be slidably connected, but the alignment rods 108 would extend up from the vertically-moving plate 106, through the horizontally-limited plate 104, and end at a cap 110 or the like. In this configuration, substantial force would be directed upwards on the plate 104, thereby stressing the linear bearing and rail assemblies, but this could be compensated for through various reinforcement mechanisms.

Although the upper die plate assembly has been illustrated as including vertical reinforcement braces 60*a*, 60*b*, these components are optional, and could either be omitted or replaced with additional alignment rods 74, if the degree of stiffness and other mechanical properties of the upper die plate assembly remained suitable for the machining task to be carried out using the rotary punch.

As noted above, the term "substantially" as used herein refers to the element in question exhibiting the stated characteristic, but for variances arising from manufacturing tolerances.

Although the upper and lower die plates have been illustrated as being H-or I-shaped, the die plates could be shaped or configured otherwise without departing from the spirit and scope of the invention. For example, the lower die plate could be rectangular if vertical reinforcement braces 60*a*, 60*b* are not used as part of the upper die plate assembly 24. The upper die plate could also be rectangular.

Figure 11:
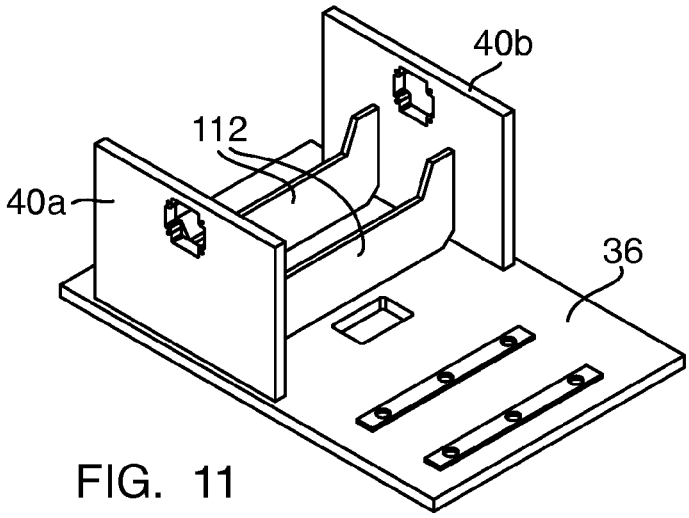
FIG. 11 is a perspective view of a base and front and rear support frame plate portions of the rotary punch, provided as a weldment.

As shown in FIG. 11, the base 36 and front and rear support frame plate portions 40*a*, 40*b* of the rotary punch may be provided as a weldment, that is, a unit formed by welding together the base and front and rear plates 40*a*, 40*b*. Cross braces 112 may also be utilized for stiffening and bracing the structure.

Since certain changes may be made in the above-described rotary punch, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A rotary punch comprising:

a primary die plate configured for movement along a generally circular pathway;

a vertically-fixed secondary die plate configured to laterally track the primary die plate, wherein a substantially constant alignment is maintained between the primary and secondary die plates as the primary die plate moves towards and away from the secondary die plate for carrying out a machining operation on a moving web of material, said web of material passing between the primary and secondary die plates;

wherein when the primary and secondary die plates are driven to move laterally at a speed that matches the speed of the moving web of material, there is substantially no relative lateral movement between the primary die plate, the secondary die plate, and the moving web of material during at least a portion of the time when the primary die plate is moved towards the secondary die plate for carrying out the machining operation on the moving web of material;

a support frame having at least one linear bearing and rail assembly, wherein the secondary die plate is operably connected to the at least one linear bearing and rail assembly for movement in a linear lateral direction only; and a crankshaft rotatably connected to the support frame, said crankshaft having a fixed longitudinal axis and at least one offset journal, wherein the primary die plate is operably connected to the at least one offset journal for movement along the generally circular pathway when the crankshaft ii rotated about the fixed axis, and wherein the primary die plate is slidably connected to the secondary die plate by way of at least one alignment rod, for the secondary die plate to laterally track the primary die plate.

2. A rotary punch comprising:

a support frame having a drive assembly;

an upper die plate assembly operably connected to the drive assembly for horizontal and vertical movement along a generally circular pathway;

a lower die plate operably connected to the support frame for movement in a linear horizontal direction only;

wherein the upper die plate assembly is slidably connected to the lower die plate for maintaining a substantially constant alignment therewith as the upper die plate assembly moves vertically towards and away from the lower die plate, said lower die plate horizontally following the upper die plate assembly, for carrying out a periodic machining operation on a moving web of material passing between the upper die plate assembly and the lower die plate;

at least one gusset plate attached to an underside of the lower die plate and extending down therefrom; and a bottom support plate attached to the at least one gusset plate, wherein the upper die plate assembly is slidably connected to the bottom support plate for vertical movement of the upper die plate assembly with respect to the bottom support plate, wherein the at least one gusset plate and bottom support plate form a box section in conjunction with the lower die plate, to stiffen the lower die plate and stabilize the moving portions of the rotary punch.

3. The rotary punch of claim 2 wherein:

the upper die plate assembly comprises:

at least one side plate having a bearing;

at least one alignment rod attached to the side plate; and an upper die plate attached to the at least one alignment rod;

the lower die plate is slidably disposed about the at least one alignment rod between the at least one side plate and the upper die plate; and the drive assembly is a crankshaft having at least one offset journal, said offset journal being operably interfaced with the side plate bearing, wherein rotation of the crankshaft about a fixed longitudinal axis of the crankshaft causes the at least one offset journal to move about a circular orbit for moving the side plate and, thereby, the upper die plate assembly, along the generally circular pathway.

4. The rotary punch of claim 3 further comprising:

a die connected to a top surface of the lower die plate; and a work member connected to a bottom surface of the upper die plate, wherein the die and work member are complementary to one another for carrying out the machining operation on the web of material.

5. The rotary punch of claim 4 wherein:

the work member is a punch; and the lower die plate includes a drop aperture formed in the lower die plate, said drop aperture cooperating with the die and punch for removing waste material originating from the machining operation.

6. The rotary punch of claim 2 wherein:

when the lower die plate and upper die plate assembly are driven to concurrently move horizontally at a speed that matches the speed of the moving web of material, there is substantially no relative horizontal movement between the upper die plate assembly, the lower die plate, and the moving web of material during at least a portion of the time when the upper die plate assembly is moved vertically towards the lower die plate for carrying out the machining operation on the moving web of material.

7. The rotary punch of claim 6 wherein:

the upper die plate assembly comprises:

at least one side plate having a bearing;

at least one alignment rod attached to the side plate; and an upper die plate attached to the at least one alignment rod;

the lower die plate is slidably disposed about the at least one alignment rod between the at least one side plate and the upper die plate; and the drive assembly is a rotating crankshaft having at least one offset journal, said offset journal being operably interfaced with the side plate bearing, wherein rotation of the crankshaft about a fixed longitudinal axis of the crankshaft causes the journal to move about a circular orbit for moving the side plate and, thereby, the upper die plate assembly, along the generally circular pathway.

8. The rotary punch of claim 7 further comprising:

a die connected to a top surface of the lower die plate; and a work member connected to a bottom surface of the upper die plate, where the die and work member are complementary to one another for carrying out the machining operation on the web of material.

9. The rotary punch of claim 8 wherein:

the work member is a punch; and the lower die plate includes a drop aperture formed in the lower die plate, said drop aperture cooperating with the die and punch for removing waste material originating from the machining operation.

10. The rotary punch of claim 7 further comprising:

at least one gusset plate attached to an underside of the lower die plate and extending down therefrom; and a bottom support plate attached to the at least one gusset plate, wherein the at least one alignment rod is slidably connected to the bottom support plate for vertical movement of the upper die plate assembly with respect to the bottom support plate, wherein the at least one gusset plate and bottom support plate form a box section in conjunction with the lower die plate, to stiffen the lower die plate and stabilize the moving portions of the rotary punch.

11. The rotary punch of claim 2 wherein:

the upper die plate assembly comprises:

first and second opposed, generally parallel and vertically oriented side plates each having a bearing;

first and second alignment rods attached to the first side plate, and third and fourth alignment rods attached to the second side plate, said first through fourth rods being parallel to one another; and an upper die plate attached to the first through fourth rods, said upper die plate being complementary to the lower die plate for carrying out a machining operation on a moving web of material passing between the upper and lower die plates;

the lower die plate is disposed laterally between first and second support frame plate portions of the support frame, each of said first and second support frame plates having a linear bearing and rail assembly, said lower die plate being operably interfaced with the linear bearing and rail assemblies for movement in the linear horizontal direction only, and said lower die plate being positioned between the upper die plate assembly side plates and upper die plate;

the drive assembly is a rotating crankshaft having two aligned offset journals, said offset journals being respectively operably interfaced with the bearings of the first and second upper die plate assembly side plates, wherein rotation of the crankshaft about a fixed longitudinal axis of the crankshaft causes the journals to move about a circular orbit, which causes the upper die plate assembly side plates and, thereby, the entirety of the upper die plate assembly, to move vertically and horizontally along the generally circular pathway;

the first through fourth alignment rods are vertically slidably connected to the lower die plate for maintaining the substantially constant alignment between the upper and lower die plates, so that as the upper die plate assembly is moved vertically and horizontally along the generally circular pathway, the lower die plate moves horizontally along with the upper die plate assembly and the upper die plate assembly moves vertically towards and away from the lower die plate; and when the lower die plate and upper die plate assembly are driven to move horizontally at a speed that matches the speed of the moving web of material, there is substantially no relative horizontal movement between the upper die plate, the lower die plate, and the moving web of material during at least a portion of the time when the upper die plate assembly is moved vertically downwards towards the lower die plate for carrying out the machining operation.

* * * * *